US009039166B2

(12) United States Patent
Hanabusa et al.

(10) Patent No.: US 9,039,166 B2
(45) Date of Patent: May 26, 2015

(54) PRINTING APPARATUS AND METHOD OF RESTRICTING MOVEMENT OF CARRIAGE

(71) Applicant: CANON KABUSHIKI KAISHA, Tokyo (JP)

(72) Inventors: Tadashi Hanabusa, Yokohama (JP); Kazuhisa Kawakami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/332,862

(22) Filed: Jul. 16, 2014

(65) Prior Publication Data

US 2015/0022609 A1 Jan. 22, 2015

(30) Foreign Application Priority Data

Jul. 19, 2013 (JP) ..... 2013-150365

(51) Int. Cl.
*B41J 25/304* (2006.01)

(52) U.S. Cl.
CPC ..... *B41J 25/304* (2013.01)

(58) Field of Classification Search
None
See application file for complete search history.

(56) References Cited

U.S. PATENT DOCUMENTS

2013/0250013 A1* 9/2013 Koichi ..... 347/86

FOREIGN PATENT DOCUMENTS

JP 5-193237 A 8/1993
JP 2001063193 A * 3/2001

* cited by examiner

*Primary Examiner* — Lisa M Solomon
(74) *Attorney, Agent, or Firm* — Canon USA Inc IP Division

(57) ABSTRACT

A printing apparatus includes a housing, a carriage in which a print head is mounted, the carriage moving inside the housing, and an openable cover provided for the housing. A restricting member configured to restrict movement of the carriage during transport of the printing apparatus is attachable to the printing apparatus. While the restricting member is attached to the apparatus, the restricting member engages with the carriage, the cover in a closed position, and the housing and part of the restricting member is exposed outside of the cover in the closed position. When the part is pulled, the restricting member disengages from the carriage, the cover, and the housing and is detached from the apparatus.

11 Claims, 13 Drawing Sheets

PRINTING APPARATUS AND METHOD OF RESTRICTING MOVEMENT OF CARRIAGE

BACKGROUND OF THE INVENTION

1. Field of the Invention

The present invention relates to a printing apparatus including a carriage and a method of restricting the carriage.

2. Description of the Related Art

In a printing apparatus including a carriage that reciprocates, the carriage may move due to impact caused during transport after factory shipment and may be broken. There have been approaches to preventing such a break. According to one of the approaches, the carriage is fastened in the apparatus by adhesive tape. A user opens a cover of the apparatus and removes the tape when unpacking and setting up the apparatus. According to another approach, the carriage is fastened in the apparatus by a retaining member (restricting member) without any tape, as disclosed in Japanese Patent Laid-Open No. 5-193237.

In either of these approaches, fastening with the adhesive tape and fastening with the restricting member as disclosed in Japanese Patent Laid-Open No. 5-193237, it is difficult for users to notice the adhesive tape or the restricting member because it is hidden within the apparatus. If the user forgets to remove the adhesive tape or the restricting member and activates the apparatus while the adhesive tape or the restricting member is left, unintended force may be applied to a driving mechanism of the carriage, resulting in breakage of the carriage.

The present invention provides a printing apparatus that prevents a user from forgetting to detach a restricting member and allows the user to set up the apparatus in a short time after transport, and a method of restricting the carriage.

SUMMARY OF THE INVENTION

An aspect of the present disclosure provides a printing apparatus including a housing, a carriage in which a print head is mounted, the carriage moving inside the housing, and an openable cover provided for the housing. A restricting member configured to restrict movement of the carriage is attachable to the printing apparatus. While the restricting member is attached to the printing apparatus, the restricting member engages with the carriage, the cover in a closed position, and the housing and part of the restricting member is exposed outside of the cover in the closed position. When the part is pulled, the restricting member disengages from the carriage, the cover, and the housing and is detached from the printing apparatus.

Further features of the present invention will become apparent from the following description of exemplary embodiments with reference to the attached drawings.

DESCRIPTION OF THE EMBODIMENTS

Figure 1:
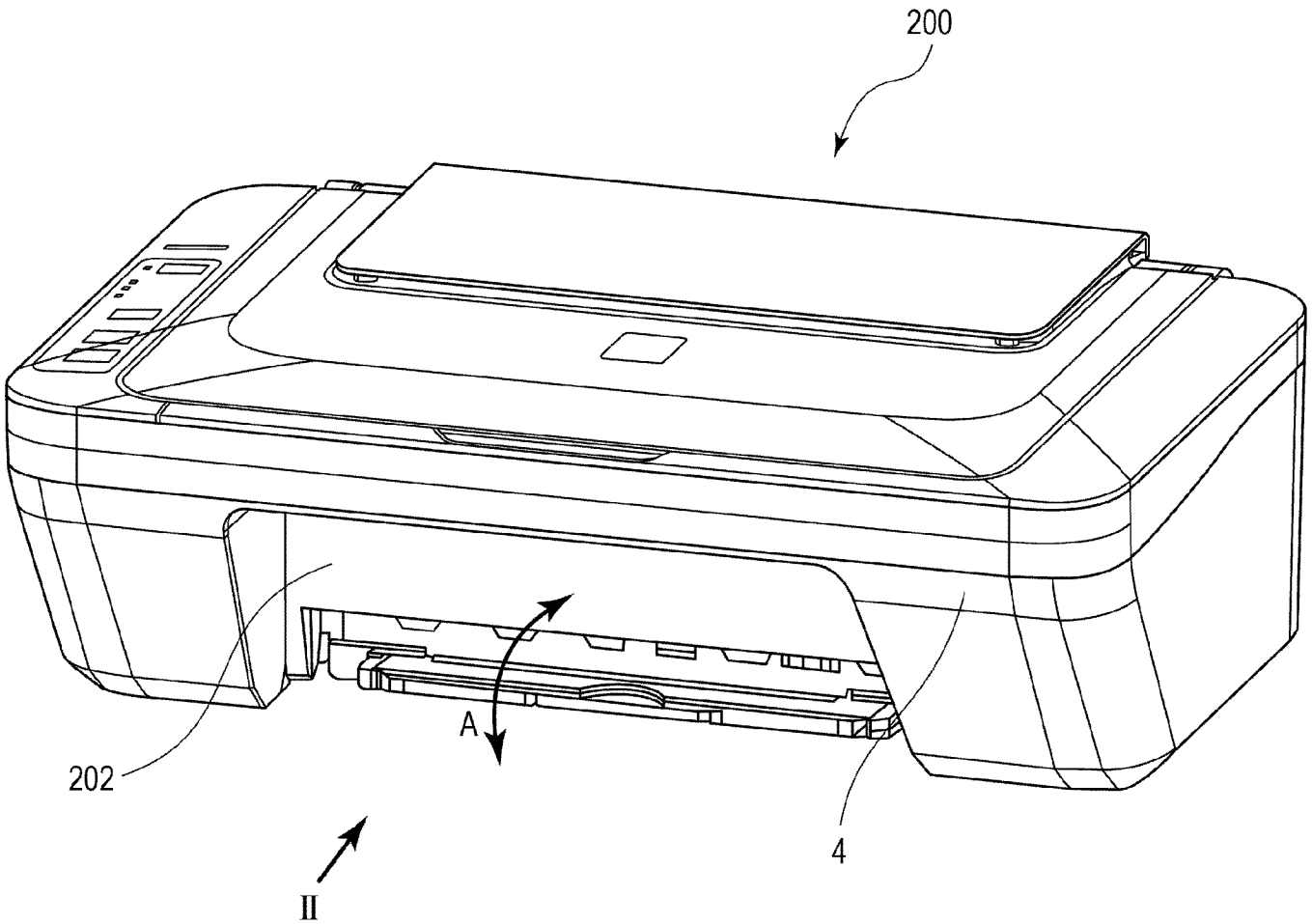
FIG. 1 is an overall schematic view of a printing apparatus (with a cover in a closed position) according to an embodiment.

FIG. 1 illustrates an outer appearance of a printing apparatus according to an embodiment of the present invention. This printing apparatus is a multifunction device that includes an image reading unit (flatbed scanner) disposed at an upper stage and a printing unit disposed at a lower stage such that these units are combined in an integrated fashion.

The printing apparatus, indicated at 200, includes a housing 4, which serves as an outer shell, accommodating inner components of the apparatus. The housing 4 includes a cover 202 that is openable by a hinge relative to the housing. The cover 202 is movable about the hinge disposed at a lower end of the cover 202 between an open position and a closed position in a direction indicated by arrow A. While the cover is opened forward of the apparatus, a user can access to the interior of the apparatus for maintenance. The maintenance includes an operation to attach, for example, a print head for image printing to a carriage and an operation to remove a jammed sheet upon paper jamming during printing. The user opens the cover 202, inserts his or her hand into an opening which is exposed, and performs the maintenance operation.

Figure 2:
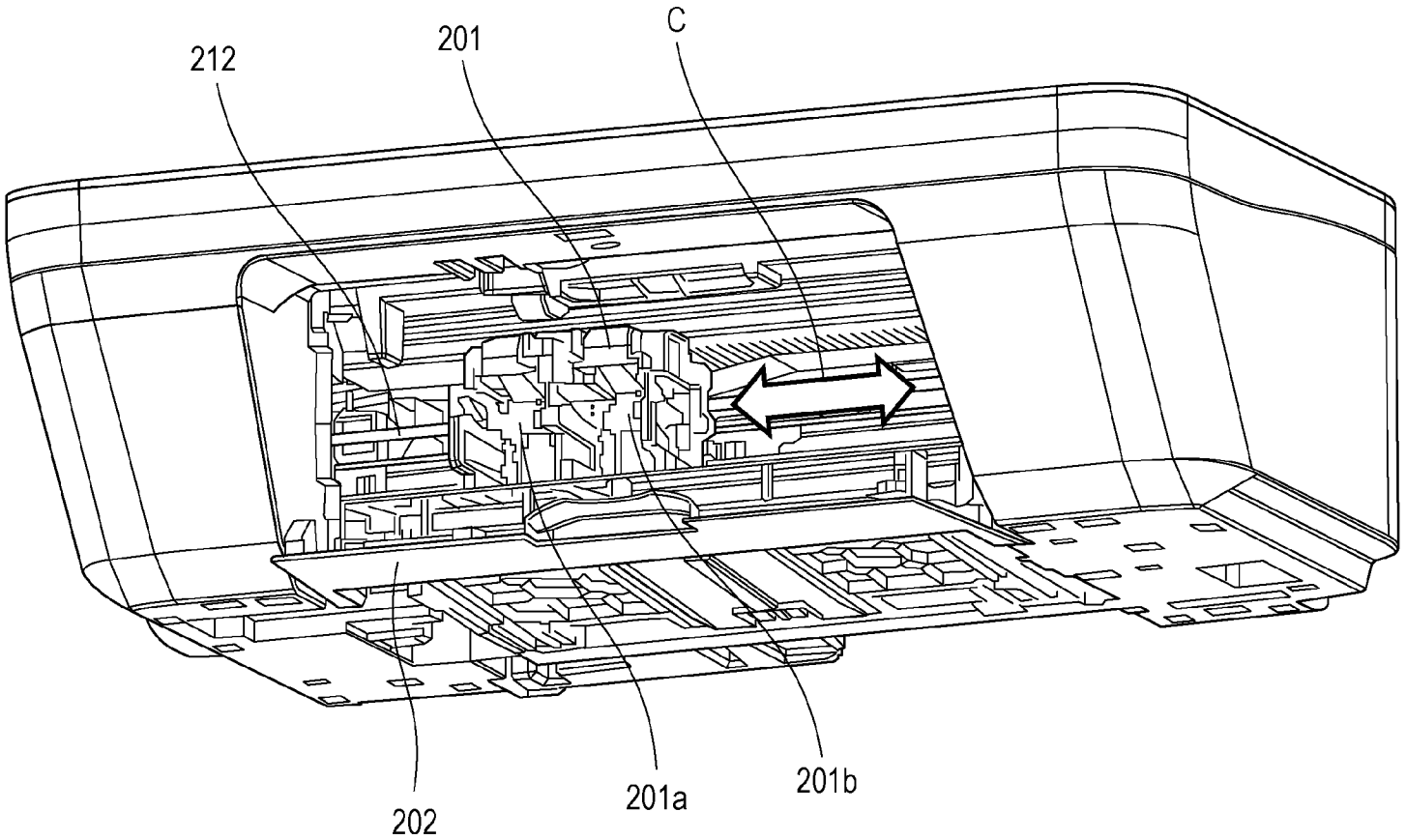
FIG. 2 is an overall schematic view of the apparatus with the cover in an open position.

FIG. 2 is a perspective view of the printing apparatus 200 with the cover 202 in the open position as viewed in a direction indicated by arrow II in FIG. 1. A carriage 201 is movable along a carriage rail 212 in a direction indicated by arrow C in a reciprocating manner. While the carriage 201 is reciprocating from side to side, ink is ejected from a print head to print an image in a serial manner. The print head and an ink reservoir are mounted in mounting portions 201*a* and 201*b* of the carriage 201. The print head and the ink reservoir may be integrated with each other or separate from each other. The print head is an inkjet head and is supplied with a plurality of color inks from the ink reservoir.

Figure 3:
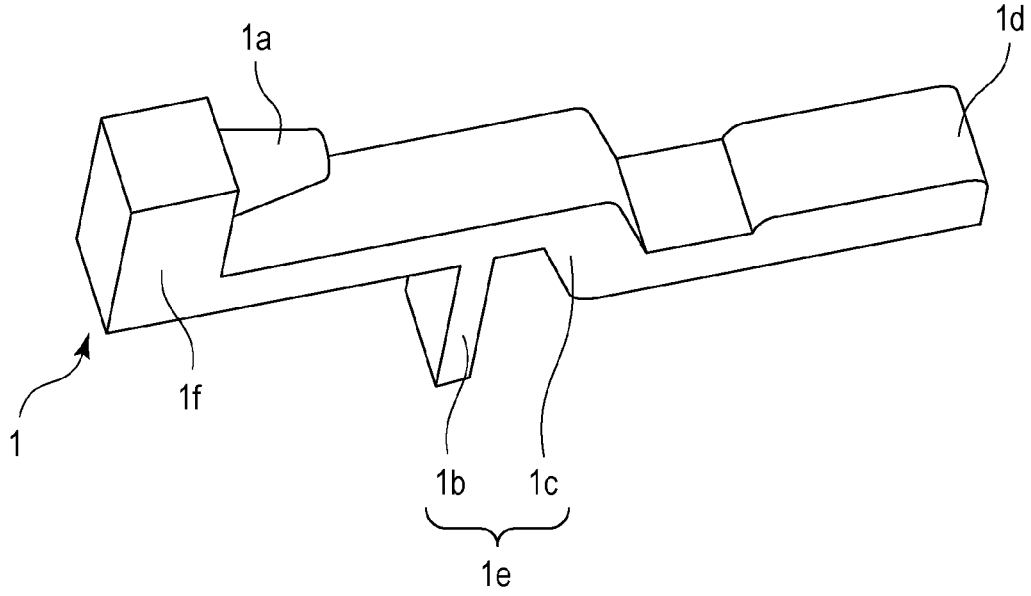
FIG. 3 is a perspective view of a restricting member.

FIG. 3 is a perspective view of a restricting member to restrict movement of the carriage 201 by fastening the carriage 201 while the apparatus 200 is transported. The restricting member is used to prevent the carriage 201 and the cover 202 from moving accidentally while the printing apparatus 200 is transported from a production factory to the user. Attachment of the restricting member to the printing apparatus 200 during transport prevents the carriage 201 and the cover 202 from moving and breaking.

The restricting member, indicated at 1, is in one piece of resin formed by injection molding and is substantially elongated and bar-shaped. Examples of resin include polypropylene (PP), polyacetal (POM), polystyrene (PS), acrylonitrile butadiene styrene (ABS), and polycarbonate (PC).

The restricting member 1 includes a lug 1*f* at a first end that is exposed outside of the cover when the restricting member 1 is attached to the apparatus 200. The lug 1*f* is to be pinched on both sides by fingers of the user and be pulled by the user. The restricting member 1 includes a first engaging portion 1*a* on an inwardly facing surface of the lug 1*f*. The first engaging portion 1*a* is to be fitted in a circular hole disposed in the housing 4 to engage with the hole. The restricting member 1 includes a second engaging portion 1*d* at a second end. The second engaging portion 1*d* is to be engaged with the carriage 201. The restricting member 1 further includes a third engaging portion 1*e* disposed at an intermediate position between the first and second ends. The third engaging portion 1*e* is to engage with an upper end of the cover 202 in the closed position. The third engaging portion 1*e* includes a leg 1*b* protruding downwardly from the restricting member 1 and a bend 1*c* disposed at substantially the intermediate position of the restricting member 1 and has a groove between the leg 1*b* and the bend 1*c*. When the groove engages with the upper end of the cover 202, the leg 1*b* restricts movement of the cover 202 to prevent opening of the cover.

Figure 4A:
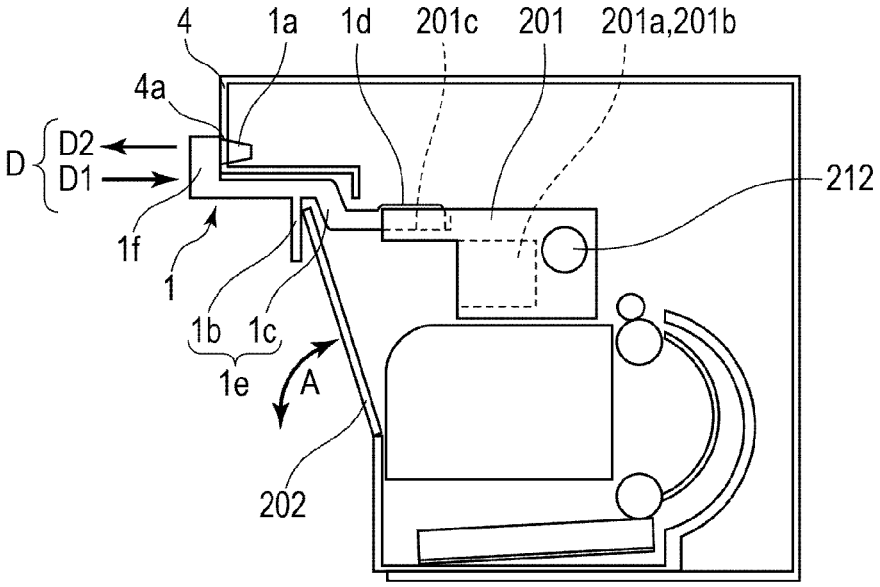
FIGS. 4A and 4B illustrate the apparatus with the restricting member attached thereto.
Figure 4B:
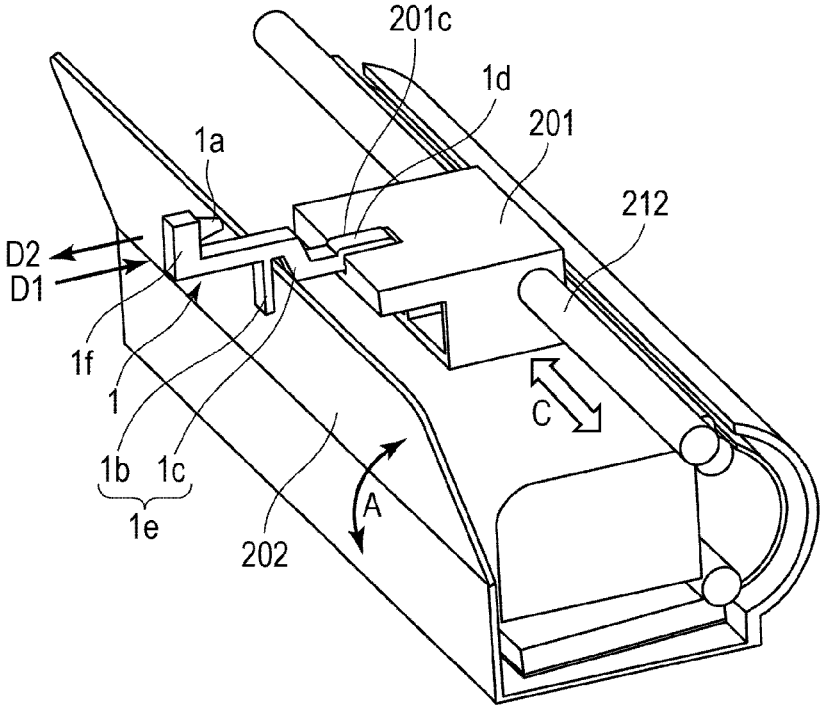

FIGS. 4A and 4B illustrate the printing apparatus 200 with the restricting member 1 attached thereto. FIG. 4A is a cross-sectional view of the printing apparatus 200 with the restricting member 1 attached thereto. FIG. 4B is a perspective view for explaining an engagement state of the restricting member 1.

The restricting member 1 is attached to the printing apparatus 200 by an operator in the production factory prior to packing of the apparatus. While being attached to the printing apparatus 200, the restricting member 1 engages with the housing 4, the cover 202 in the closed position, and the carriage 201, that is, three portions of the printing apparatus 200. The restricting member 1 partly protrudes from the closed cover 202 such that part of the restricting member 1 is exposed outside of the cover 202 and the housing 4.

For the engagement between the housing 4 and the restricting member 1, the first engaging portion 1*a* is fitted in the circular hole, indicated at 4*a*, disposed in the housing 4. The first engaging portion 1*a* is shaped in a tapered cylinder. When the first engaging portion 1*a* is pressed in a direction indicated by arrow D1, the cylinder is partly deformed and fitted into the circular hole 4*a*.

For the engagement between the cover 202 and the restricting member 1, the third engaging portion 1*e* engages with a portion of the upper end of the cover 202 and the portion is at a position excluding right and left edges of the upper end. Since the cover 202 is in close proximity to the inner components of the printing apparatus 200 because of miniaturization of the apparatus, vibrations or high impact during transport of the apparatus may cause an inner surface of the cover 202 to hit against the inner components arranged inside the housing. To prevent such an accident, the cover 202 may be partly opened while the restricting member 1 is attached to the printing apparatus 200 to fasten the cover 202. In this specification, such a partly opened state of the cover during attachment of the restricting member to the apparatus is regarded as a substantially closed state and the cover in this state is expressed as being in the "closed position".

For the engagement between the carriage 201 and the restricting member 1, the second engaging portion 1*d* of the restricting member 1 is fitted in a groove 201*c* disposed in an upper surface of the carriage 201 to engage with the groove 201*c*. The groove 201*c* is elongated in the direction in which the restricting member 1 is pulled.

Figure 5:
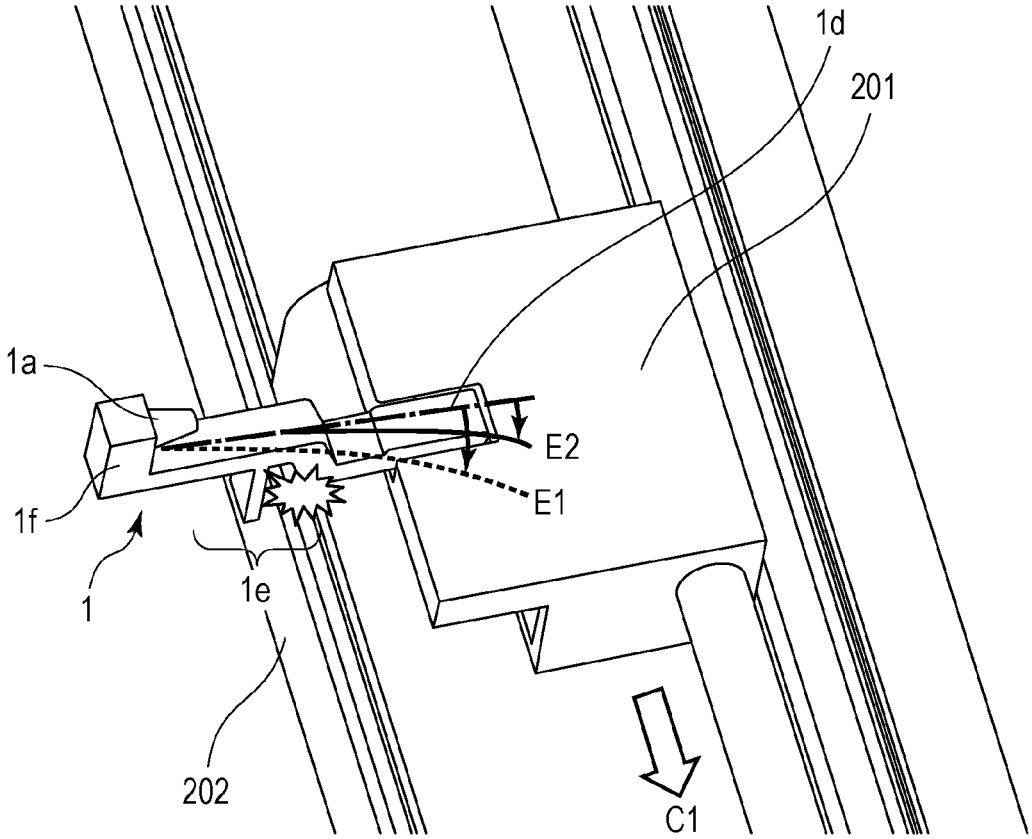
FIG. 5 illustrates a state in which a carriage is restricted by the restricting member.

FIG. 5 is an enlarged view of part of the printing apparatus where the second engaging portion 1*d* of the restricting member 1 engages with the groove 201*c* of the carriage 201. Since the restricting member 1 is elongated and bar-shaped and is made of deformable resin, the restricting member 1 may deform under force applied due to movement of the carriage 201 in a direction C1 caused by impact during transport. If the amount of deformation increases due to high impact, an accident would occur, for example, the restricting member 1 would disengage from the carriage 201, alternatively, the restricting member 1 would break. According to this embodiment, the cover 202 supports the restricting member 1, thus reducing the deformation of the restricting member 1. Specifically, the upper end of the cover 202 supports the third engaging portion 1*e* of the restricting member 1, so that the restricting member 1 deforms such that the third engaging portion 1*e* functions as a fulcrum. Thus, the restricting member 1 deforms up to a position E2. If the restricting member 1 does not include the third engaging portion 1*e*, the restricting member 1 would significantly deform to a position E1 such that the first engaging portion 1*a* functions as a fulcrum.

To detach the restricting member 1 from the printing apparatus 200 for setup upon unpacking the apparatus after purchase, the user only has to pinch the lug 1*f* exposed outside of the cover 202 on both sides and pull the lug 1*f* in a direction indicated by arrow D2 in FIG. 4. Such a single-action operation enables opening of the cover 202 and disengagement of the restricting member 1 from the carriage 201, the cover 202, and the housing 4, so that the restricting member 1 is detached. When the lug 1*f* is pulled, the first engaging portion 1*a* is withdrawn from the circular hole 4*a* of the housing 4, thus achieving disengagement. Since the groove 201*c* of the carriage 201 extends along the direction D2 (hereinafter, referred to as the "pulling direction") in which the restricting member 1 is pulled, the groove 201*c* provides little or no resistance to the pulled restricting member 1, so that the restricting member 1 can be smoothly pulled. In addition, since the cover 202 is opened about the hinge in the same direction as the pulling direction D2, the cover 202 is smoothly opened as the restricting member 1 is pulled.

Since the user only has to pinch part (the lug 1*f*) of the restricting member 1 exposed from the printing apparatus 200 and pull the part after unpacking the apparatus, an operation to set up the apparatus is easy. Since the carriage 201 and the cover 202 are fastened by the single restricting member 1, the setup operation can be performed more easily than that for a related-art printing apparatus with a carriage and a cover individually fastened by adhesive tape. In addition, since the lug 1*f* included in the restricting member 1 is exposed outside of the cover 202 and is thus easy to notice, the user is prevented from forgetting to detach the restricting member 1 from the printing apparatus 200 and activating the apparatus while the restricting member 1 is left.

Figure 6A:
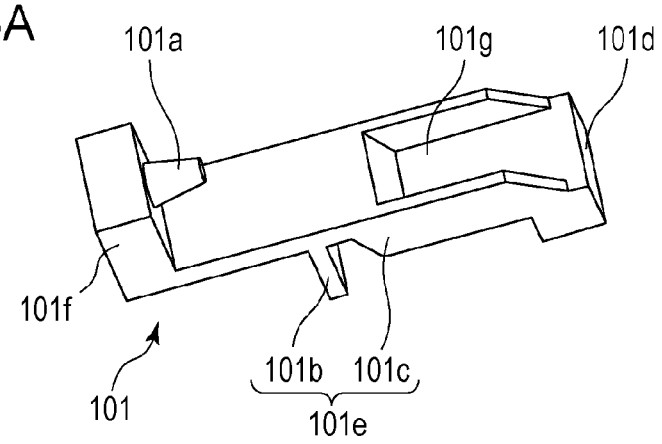
FIGS. 6A to 6C illustrate a restricting member according to a first modification.

The shape of the restricting member 1 is not limited to the above-described one. The restricting member 1 may have any shape of modifications. FIG. 6A is a perspective view of a restricting member 101 according to a first modification. The restricting member 101 differs from the restricting member 1 of FIG. 3 in that the restricting member 101 has a groove 101*g*, serving as a fourth engaging portion.

Figure 6B:
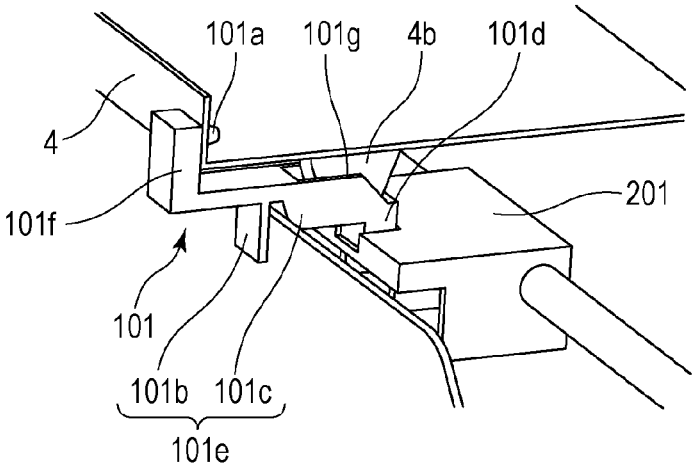

FIG. 6B illustrates the restricting member 101 attached to the printing apparatus 200. A protrusion (fastener) 4*b* is disposed inside the housing 4 (or on a lower surface of the flatbed scanner). The protrusion 4*b* is fitted into the groove-shaped fourth engaging portion 101*g* disposed in the restricting member 101 to engage therewith.

Figure 6C:
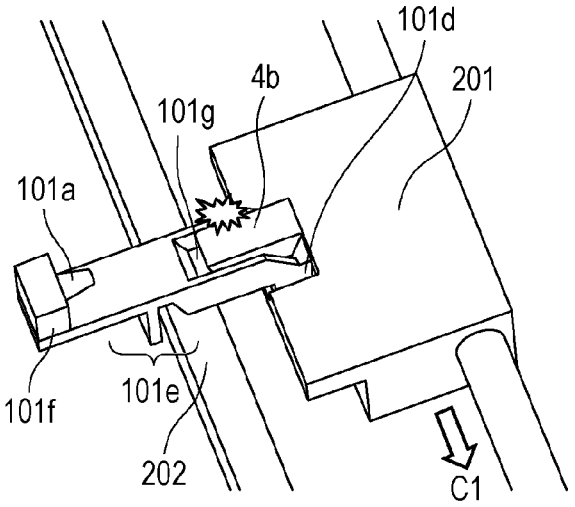

FIG. 6C is a diagram for explaining engagement between the groove 101*g* and the protrusion 4*b*. When the carriage 201 moves in the direction C1 under impact during transport, the restricting member 101 receives force. At this time, since the protrusion 4*b* engages with the groove 101*g*, the restricting member 101 deforms such that the position of the groove 101*g* coincides with a fulcrum. Thus, the deformation of part of the restricting member 101 adjacent to the carriage 201 is further reduced as compared with that in the foregoing embodiment. In other words, as supported part of the restricting member is closer to the carriage 201, the deformation of the restricting member is less. The first modification in FIGS. 6A to 6C in which the restricting member 101 is supported in the vicinity of the carriage 201 enables the carriage 201 to be continuously fastened under high impact during transport. The protrusion 4*b* is not limited to be included in the housing 4. The housing 4 may have a groove and the restricting member may include a protrusion so that the groove engages with the protrusion.

FIGS. 7 to 10 illustrate a restricting member according to a second modification. The second modification differs from the foregoing embodiment illustrated in FIG. 3 in the manner of engaging the restricting member with the housing. Furthermore, the second modification differs from the embodiment in that the restricting member includes a portion shaped so as to prevent a sensor for detecting opening and closing of the cover from being continuously pressed.

Figure 7:
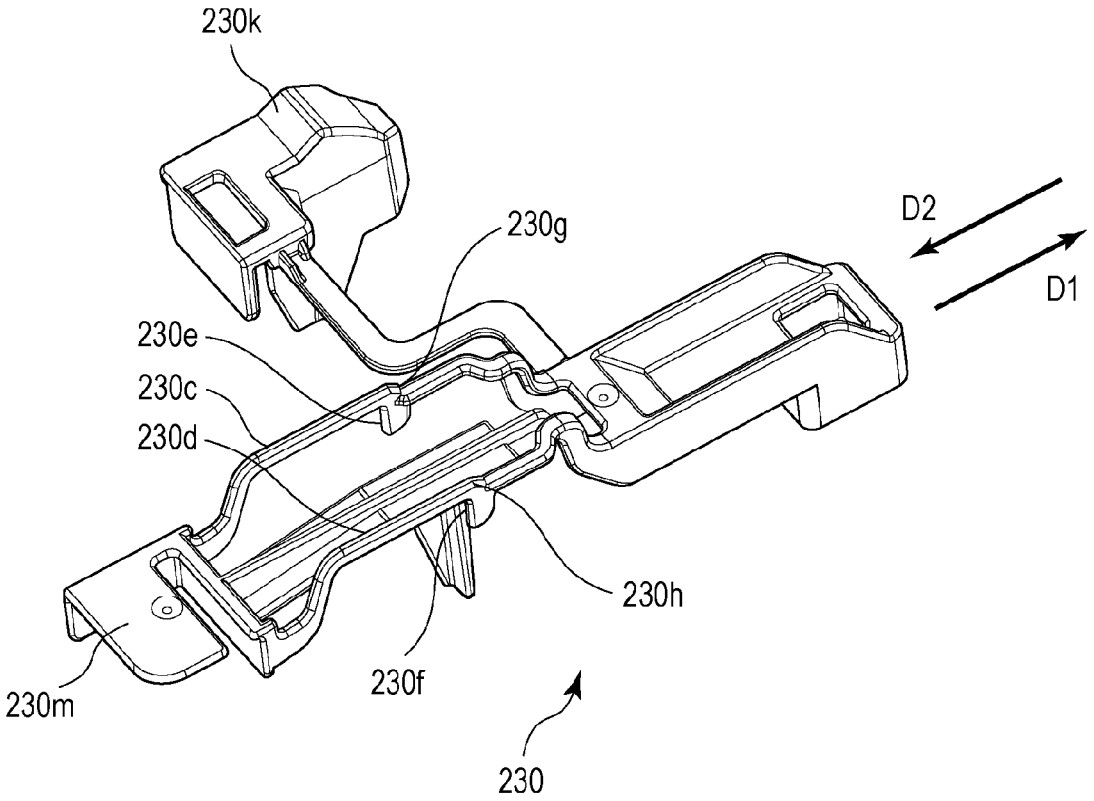
FIG. 7 is a perspective view of a restricting member according to a second modification.

FIG. 7 is a perspective view of the restricting member indicated at 230. Two arms 230*c* and 230*d*, serving as thin parts of the restricting member 230 in one piece, are flexibly deformable. Restricted parts 230*e* and 230*f* restrict movement of the restricting member 230 in the direction D2. Restricted parts 230*g* and 230*h* restrict movement of the restricting member 230 in the direction D1. A lug 230*m* is to be pinched between fingers of the user when the user detaches the restricting member 230.

Figure 8:
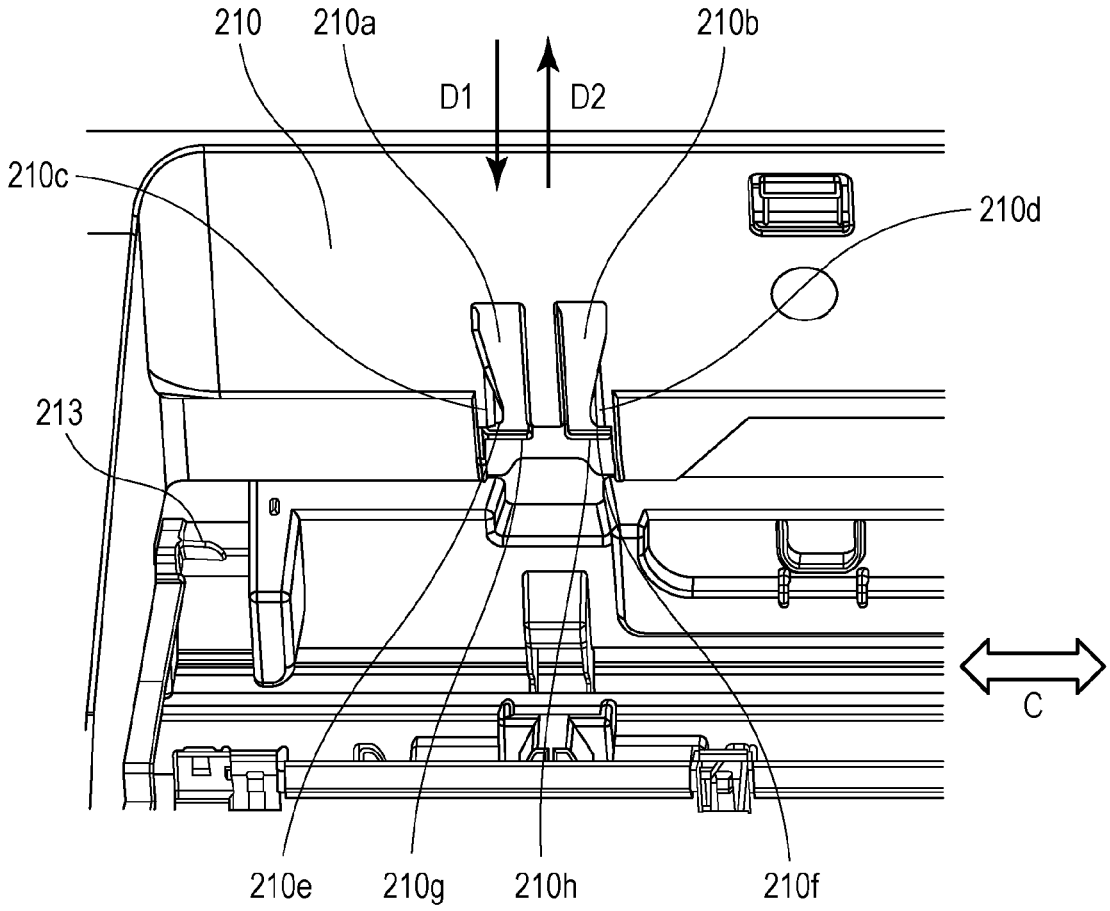
FIG. 8 illustrates openings arranged in a housing in the second modification.

FIG. 8 illustrates part of a printing apparatus, the part including openings of a housing 210 which are to engage with the restricting member 230. The housing 210 has the openings, indicated at 210*a* and 210*b*, which are to engage with the arms 230*c* and 230*d*, respectively. Slanting parts 210*c* and 210*d* are arranged in the openings 210*a* and 210*b*, respectively, such that each opening is reduced in area in the direction D1. Restricting parts 210*e* and 210*f* restrict movement of the restricting member 230 in the direction D2. Restricting parts 210*g* and 210*h* restrict movement of the restricting member 230 in the direction D1.

Figure 9:
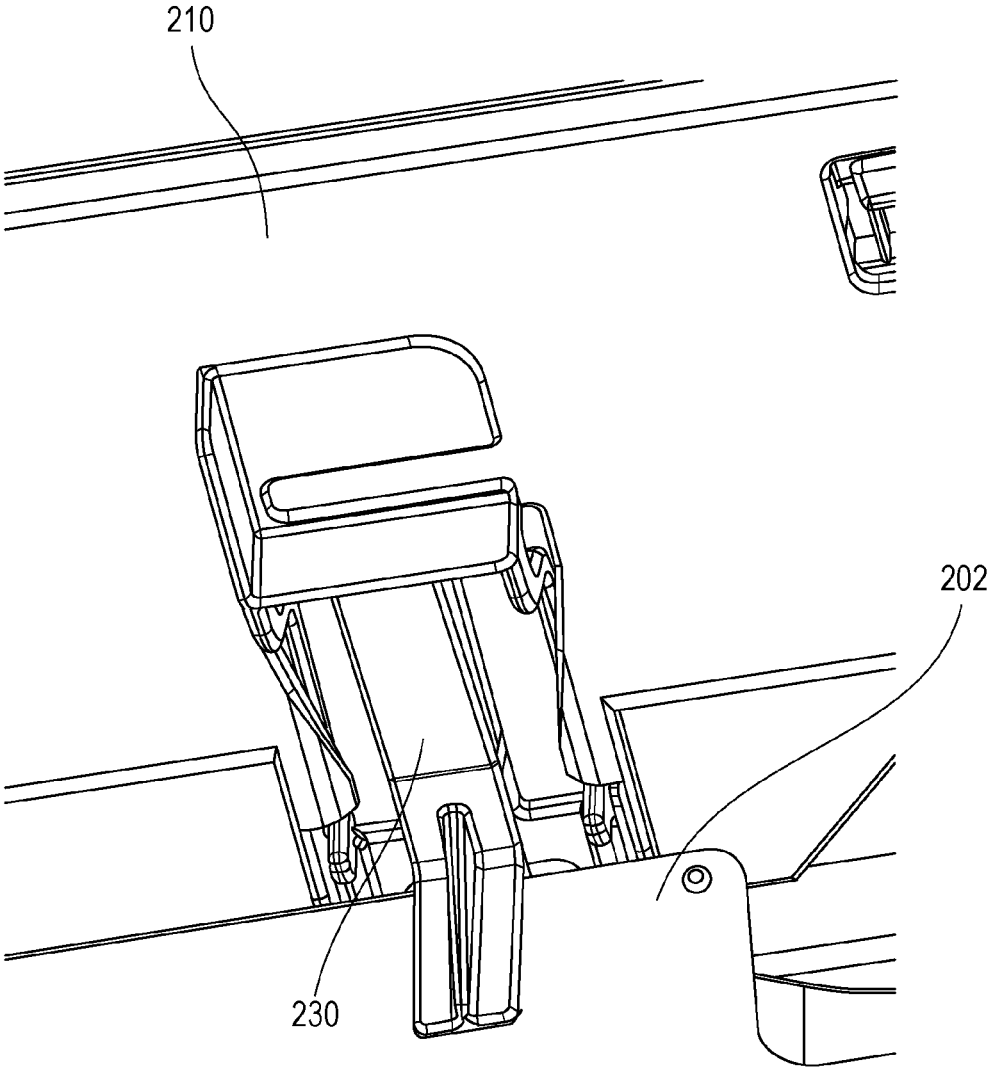
FIG. 9 is an enlarged view illustrating the restricting member attached to the housing in the second modification.

FIG. 9 illustrates the restricting member 230 attached to the openings of the housing 210. The restricting member 230 is restricted by the housing 210 and simultaneously restricts movement of the carriage 201 and the cover 202.

Figure 10A:
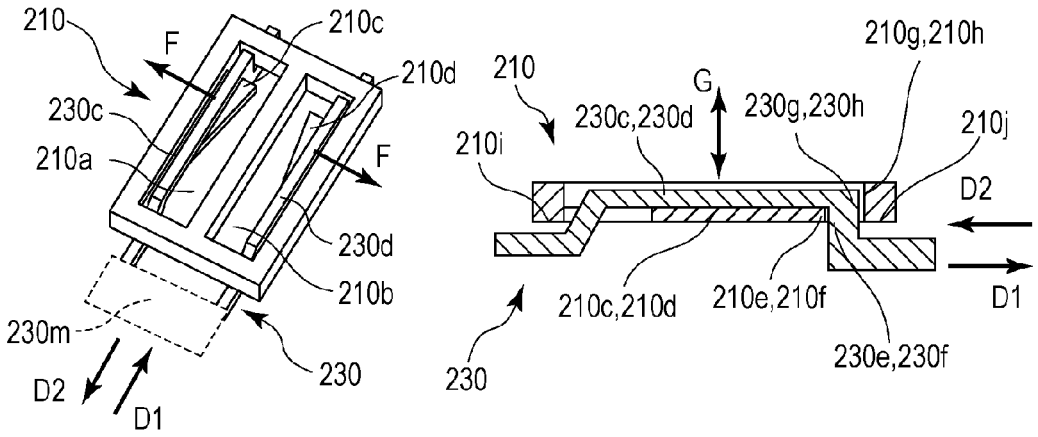
FIGS. 10A to 10C are diagrams for explaining detachment of the restricting member in the second modification.
Figure 10B:
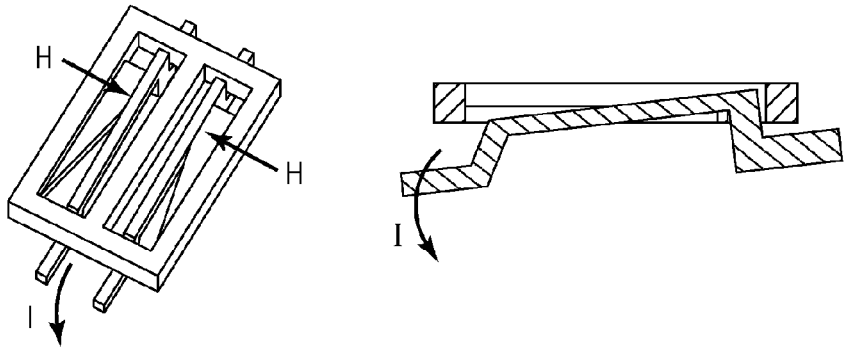
Figure 10C:
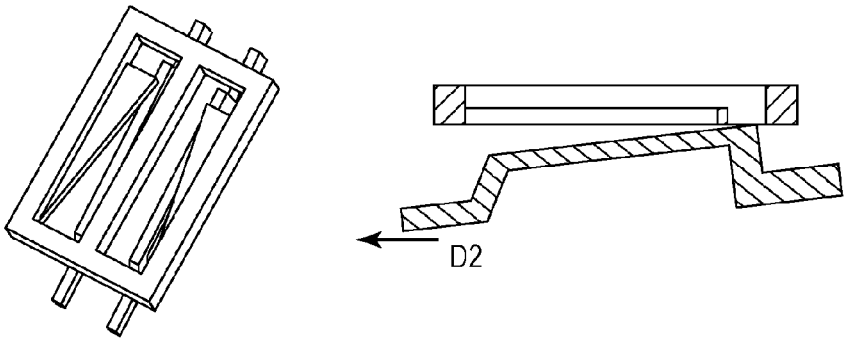

FIGS. 10A to 10C are diagrams for explaining a procedure for detaching the restricting member 230. FIG. 10A includes a perspective view of the restricting member 230 attached to the housing 210 and a longitudinal sectional view thereof. The arms 230*c* and 230*d* are attached to the housing 210 such that the arms are elastically deformed. Force acting in a direction indicated by arrow F is constantly applied to each of the arms 230*c* and 230*d*. When each of the arms 230*c* and 230*d* comes into contact with the housing 210 in the direction F, the movement of the restricting member 230 in the direction F is restricted. The slanting parts 210*c* and 210*d* and flat parts 210*i* and 210*j* of the housing 210 restrict movement of the restricting member 230 in a direction indicated by arrow G. The restricting parts 210*g* and 210*h* of the housing 210 abut against the restricted parts 230*g* and 230*h* of the restricting member 230, respectively, thus restricting the movement of the restricting member 230 in the direction D1. The restricting parts 210*e* and 210*f* of the housing 210 abut against the restricted parts 230*e* and 230*f* of the restricting member 230, respectively, thus restricting the movement of the restricting member 230 in the direction D2. The movement of the restricting member 230 is reliably restricted in this manner in the state of FIG. 10A.

FIG. 10B illustrates a step of detaching the restricting member 230 from the housing 210. The user pinches the lug 230*m* while touching upper and lower surfaces of the lug 230*m* and then rotates the restricting member 230 in a direction indicated by arrow I. Consequently, the arms 230*c* and 230*d* come into contact with slanting surfaces of the slanting parts 210*c* and 210*d*, respectively. When the user further rotates the restricting member 230 in the direction I, contact points between the arms 230*c* and 230*d* and the slanting surfaces move downstream in the direction D1. Thus, each of the arms 230*c* and 230*d* gradually deforms in a direction indicated by arrow H. Finally, the arms 230*c* and 230*d* are detached from the openings 210*a* and 210*b*, respectively, as illustrated in FIG. 10C. The restricting member 230 is accordingly movable in the direction D2. The user can remove the restricting member 230 only by pulling it in the direction D2.

As illustrated in FIG. 8, the printing apparatus is provided with a sensor unit 213 to detect opening of the cover. The sensor unit 213 includes a sensor lever and a tact switch (press switch). When the cover 202 is opened, the sensor lever of the sensor unit 213 presses the tact switch, thus detecting opening of the cover 202. Since the cover 202 in the partly opened state is fastened by the restricting member as described above, the tact switch is continuously pressed during fastening by the restricting member. If a period from factory shipment to the time when the user unpacks and sets up the printing apparatus is long, the tact switch would be continuously pressed for such a long time. A spring component in the switch may deform.

According to this modification, part of the restricting member 230 prevents the switch from being pressed while the restricting member 230 is attached to the printing apparatus. Specifically, as illustrated in FIG. 7, the restricting member 230 includes a protrusion 230*k* to press the sensor lever upward so as to keep the sensor lever apart from the tact switch. Since the component that prevents the switch from being pressed is integrated in one piece with the restricting member 230, the protrusion 230*k* is detached simultaneously with detachment of the restricting member 230. This facilitates the setup operation of the apparatus.

Figure 11:
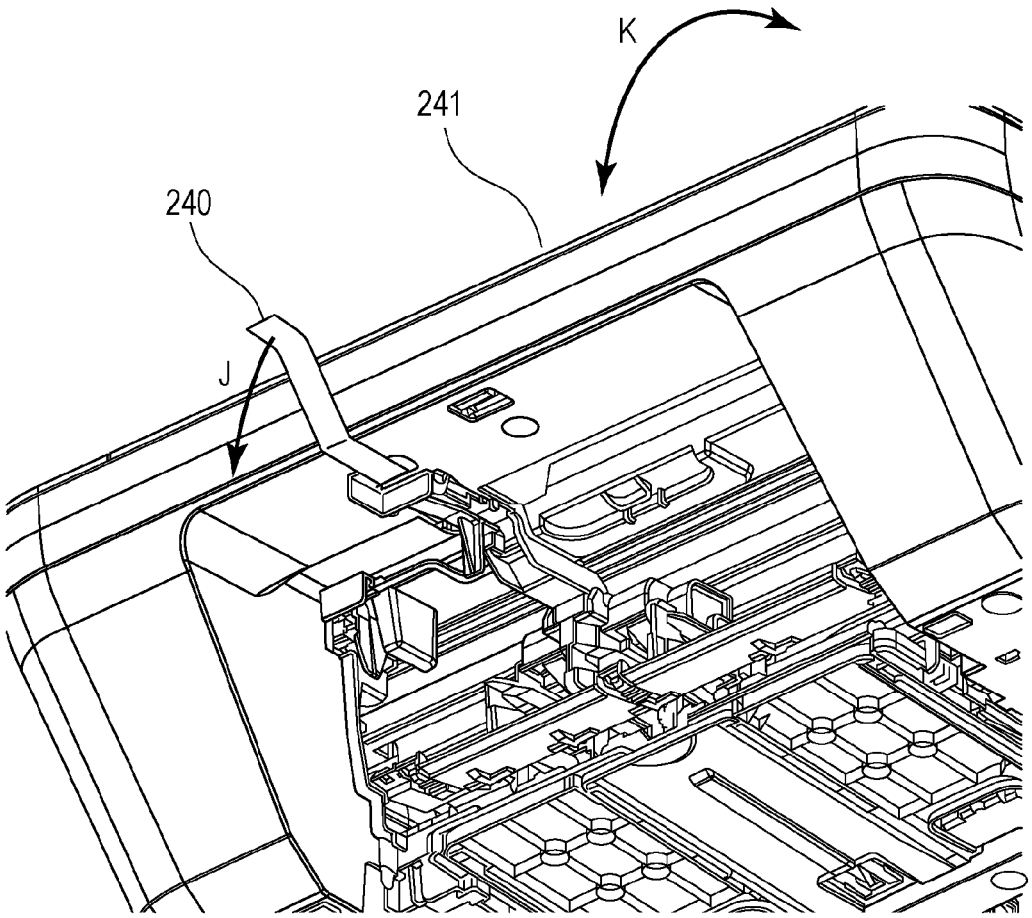
FIG. 11 illustrates a case where tape is attached to the restricting member in the second modification.

To increase ease of setup for the user, tape 240 may be used as illustrated in FIG. 11. The tape 240 is attached to the lug 230*m* of the restricting member 230 and is considerably exposed outside of the housing. The user can detach the restricting member 230 by pulling the tap 240 in a direction indicated by arrow J. Since the user cannot open an image reading unit (flatbed scanner) 241 (in a direction indicated by arrow K) unless removing the tape 240, the user does not perform a wrong setup procedure.

The setup involves attaching the print head and the ink reservoir to the carriage 201 after detachment of the restricting member. To increase ease of attachment, a position at which the carriage 201 is restricted by the restricting member is set so as to coincide with a position at which the user attaches the print head to the carriage 201. This enables the user to attach the print head to the carriage, from which the restricting member has disengaged, without moving the carriage from the position at which the carriage has been fastened by the restricting member. Thus, time and trouble to move the carriage in the direction C can be eliminated.

According to the above-described embodiment and modifications (hereinafter, collectively referred to as "embodiments"), the restricting member is attached to the housing, serving as the outer shell of the printing apparatus. The restricting member is accordingly easy for the user to notice, thus preventing the user from forgetting to detach the restricting member. Additionally, easy detachment of the restricting member saves the user the steps of detaching. Furthermore, restriction of the carriage and the cover by the single restricting member results in less steps of detaching the restricting member than restriction by individual restricting members. In addition, the cover placed between the housing and the carriage and the protrusion of the housing are used as supports, thereby reducing the deformation of the restricting member. In the printing apparatus including the image reading unit, opening of the image reading unit may be restricted by tape. In this case, the tape may be attached to the restricting member and the direction in which the tape is removed may be allowed to coincide with the direction in which the restricting member is removed. This saves the user the steps of removing.

Figure 12A:
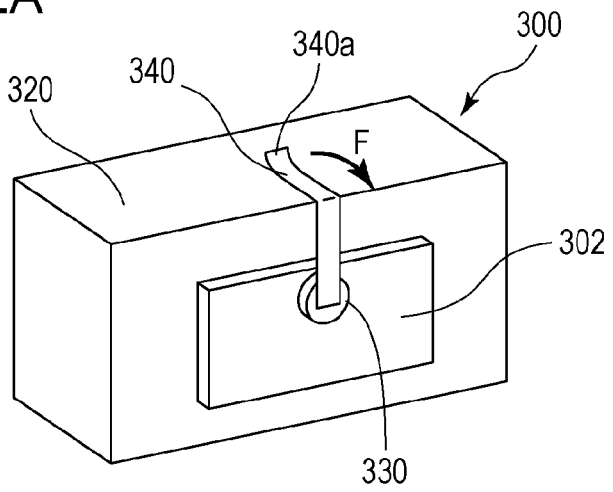
FIGS. 12A to 12C illustrate a restricting member according to a third modification.
Figure 12B:
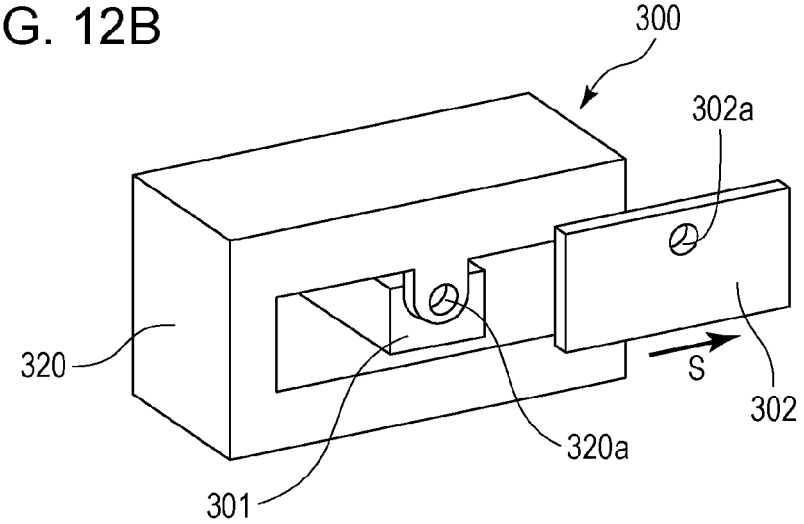
Figure 12C:
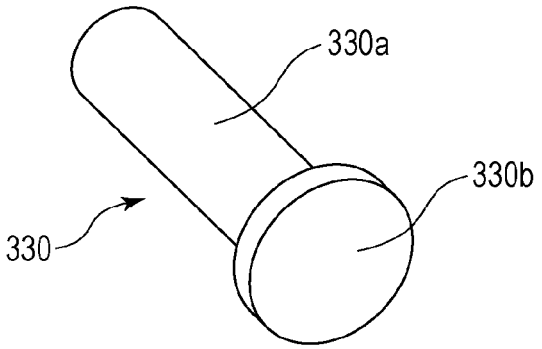

FIGS. 12A to 12C illustrates a third modification. Although the foregoing embodiments illustrate the printing apparatus in which the cover is opened about the hinge so as to fall forward of the apparatus, the cover may be opened so as to slide relative to the housing. FIG. 12A is a schematic diagram illustrating a state in which a restricting member 330 is attached to a housing 320. FIG. 12B is a schematic diagram illustrating a state in which the restricting member 330 is detached and a cover 302 is opened.

The housing 320 of a printing apparatus 300 has a through-hole 320*a* to be fitted around the restricting member 330. The cover 302 is opened for maintenance, such as jammed sheet removal, print head attachment, or the like by sliding the cover in a direction indicated by arrow S. The cover 302 has a through-hole 302*a* to be fitted around the restricting member 330. A carriage 301 in which the print head is mounted reciprocates in the direction S inside the housing 320. The carriage 301 has a fit hole to be fitted around the restricting member 330.

FIG. 12C is a perspective view of the restricting member 330. The restricting member 330 includes a cylindrical shaft 330*a* and a flange 330*b*. The shaft 330*a* extends through the fit hole of the carriage 301, the through-hole 320*a* of the housing 320, and the through-hole 302*a* of the cover 302 to maintain these components in fastened relation with respect to one another. To detach the restricting member 330 from the printing apparatus 300 in order to set up the apparatus, the user may hold and pull the flange 330*b* in the direction along the axis of the restricting member 330 (or orthogonal to the direction S). Tape 340 is attached to the flange 330*b* of the restricting member 330. The user may hold and pull an end 340*a* of the tape 340.

Figure 13:
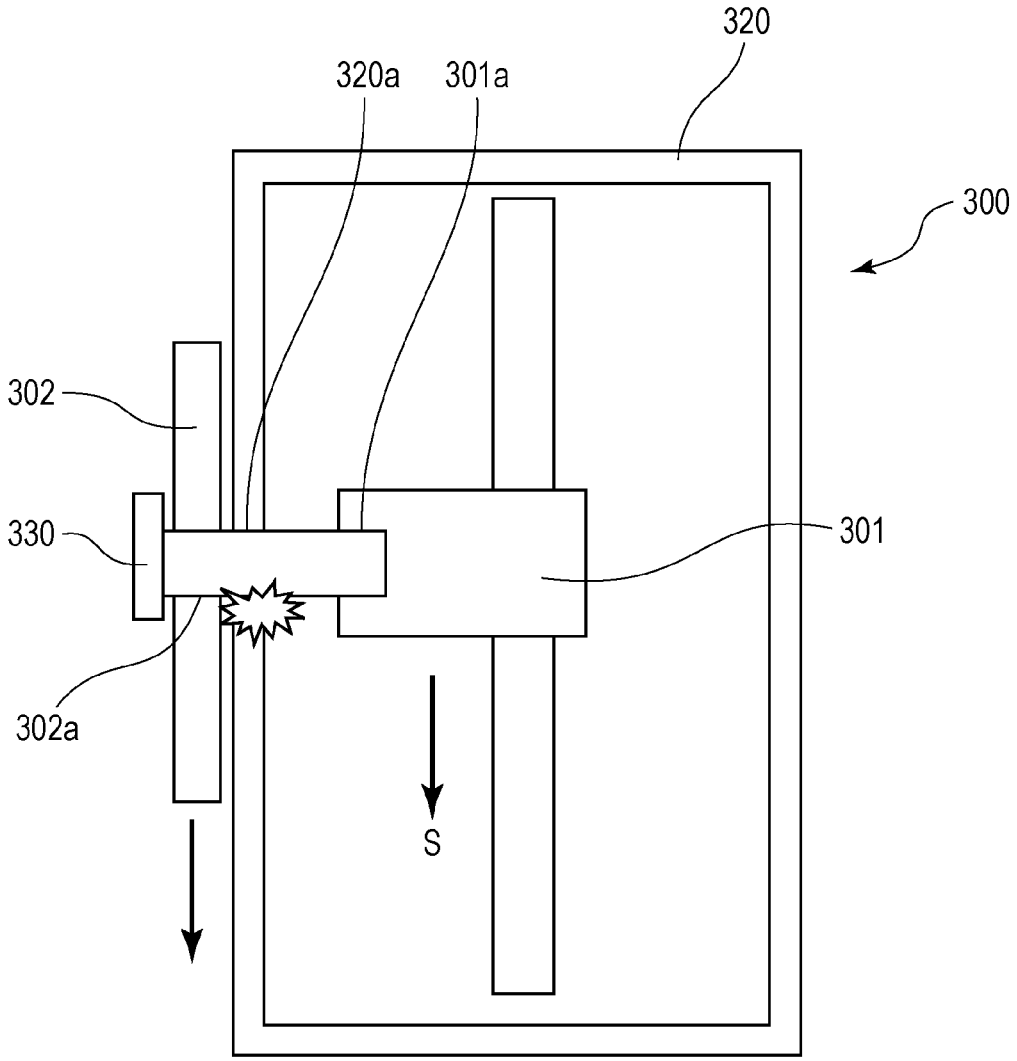
FIG. 13 illustrates a state in which a carriage is restricted by the restricting member in the third modification.

FIG. 13 is a longitudinal sectional view of the apparatus in the state illustrated in FIG. 12A as viewed from above. If impact acting in the direction S is applied to the apparatus during transport, the carriage 301 and the cover 302 would tend to move together in the direction S. Since a restriction position of the restricting member 330 relative to the housing 320 is located (in the vicinity of the through-hole 302*a* in FIG. 13) between the carriage 301 and the cover 302, however, the amount of deformation of the restricting member 330 is distributed. Thus, the occurrence of an accident, such as disengagement of the restricting member 330 from the carriage 301, can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-150365 filed Jul. 19, 2013, which is hereby incorporated by reference herein in its entirety.

What is claimed is:

1. A printing apparatus comprising:

a housing;

a carriage in which a print head is mounted, the carriage moving inside the housing; and an openable cover provided for the housing, wherein a restricting member configured to restrict movement of the carriage is attachable to the printing apparatus, wherein while the restricting member is attached to the printing apparatus, the restricting member engages with the carriage, the cover in a closed position, and the housing and part of the restricting member is exposed outside of the cover in the closed position, and wherein when the part is pulled, the restricting member disengages from the carriage, the cover, and the housing and is detached from the printing apparatus.

2. The apparatus according to claim 1, wherein when the part is pulled, the cover is opened and the restricting member is detached.

3. The apparatus according to claim 2, wherein a hinge disposed at a lower end of the cover allows the cover to be opened forward of the housing, and wherein the restricting member engages with a portion of an upper end of the cover, the portion being at a position excluding right and left edges of the upper end.

4. The apparatus according to claim 1, wherein the restricting member engages with a fastener disposed inside the housing while the restricting member is attached to the apparatus.

5. The apparatus according to claim 1, further comprising:

an openable image reading unit provided for the housing, wherein the restricting member includes a lug to be pinched and pulled by a user, and wherein while the image reading unit is fastened with tape during transport of the apparatus, an end of the tape is attached to the lug.

6. The apparatus according to claim 1, wherein the restricting member includes an engaging portion to engage with a hole disposed in the housing, an engaging portion to engage with a groove disposed in the carriage, and an engaging portion to engage with an upper end of the cover.

7. The apparatus according to claim 1, wherein the housing has an opening with which an arm included in the restricting member engages, and wherein when the part is pulled, the arm disengages from the opening while deforming due to contact with the opening.

8. The apparatus according to claim 1, wherein while the restricting member is attached to the apparatus, the cover is partly opened.

9. The apparatus according to claim 8, further comprising:

a switch configured to detect opening of the cover, wherein while the restricting member is attached to the apparatus, part of the restricting member prevents the switch from being pressed.

10. The apparatus according to claim 1, wherein the print head is attached to the carriage from which the restricting member has disengaged while the carriage is kept at a position at which the carriage has been fastened by the restricting member.

11. A method of restricting movement of a carriage using a detachable restricting member, the carriage being included in a printing apparatus that includes a housing and an openable cover provided for the housing, the carriage in which a print head is mounted moving inside the housing, the method comprising:

attaching the restricting member such that the restricting member engages with the carriage, the cover in a closed position, and the housing and part of the restricting member is exposed outside of the cover in the closed position to restrict the movement of the carriage, wherein when the part is pulled, the restricting member disengages from the carriage, the cover, and the housing and is detached from the apparatus.

* * * * *